US005311672A

United States Patent [19]

Kotitschke et al.

[11] Patent Number: 5,311,672

[45] Date of Patent: May 17, 1994

[54] DRY END OF A MACHINE FOR THE PRODUCTION OF A FIBER WEB

[75] Inventors: Gerhard Kotitschke, Steinheim; Wilfried Kraft, Heidenheim, both of Fed. Rep. of Germany

[73] Assignee: J. M. Voith GmbH, Fed. Rep. of Germany

[21] Appl. No.: 931,261

[22] Filed: Aug. 17, 1992

[30] Foreign Application Priority Data

Jun. 5, 1992 [DE] Fed. Rep. of Germany ..... 4218595

[51] Int. Cl.[5] ..... F26B 11/02

[52] U.S. Cl. ..... 34/117; 34/121; 162/359.1

[58] Field of Search ..... 34/117, 120, 121, 114, 34/115; 162/363, 207, 359.1

[56] References Cited

U.S. PATENT DOCUMENTS 3,801,426 4/1974 Putman et al. .
4,080,656 3/1978 Jonsson et al. .
4,359,827 11/1982 Thomas .
4,945,655 9/1990 Wedel .
4,986,009 1/1991 Haessner et al. .
5,101,577 4/1992 Wedel .

FOREIGN PATENT DOCUMENTS 351356 1/1977 Austria .

*Primary Examiner*—Henry A. Bennet
*Attorney, Agent, or Firm*—Ostrolenk, Faber, Gerb & Soffen

[57] ABSTRACT

A paper making machine comprises a press followed by an adjoining dry end having a plurality of dryer groups I to VI. Each dryer group comprises only one row of dryer cylinders and one row of reversal suction rolls which alternate with the dryer cylinders, and a respective endless support belt passing around the cylinders and rolls of each group along a guided meander path. The press and each of the dryer groups has a respective variable web speed drive. A speed control device controls the drives such that a positive difference in speed is present between the first dryer group and the press and a negative difference in speed is present between the last two dryer groups. Separation places may be defined between at least some of the dryer groups. Some of the separation places are closed providing support for the web passing between groups, and others are open providing an unsupported open draw for the web.

20 Claims, 3 Drawing Sheets

DRY END OF A MACHINE FOR THE PRODUCTION OF A FIBER WEB

BACKGROUND OF THE INVENTION

The present invention relates to a machine for producing a fiber web, particularly a paper web, and particularly relates to the dry end of the machine. The machine has a press section followed in the web path by a dryer section. The dryer section comprises a plurality of separated dryer groups, each operable at a respective different speed. Each dryer group includes a plurality of dryers, a plurality of web path reversal and suction rolls, one between each two dryers, and an endless loop web support belt, which is sometimes a dryer felt, passing around the dryer group in a meander path past the dryer cylinders and the reversal rolls and past guide means which guide the support belt in the endless loop. After the web to be produced from a fiber suspension is formed and partly dewatered in a wire end or forming end or wet end of the machine, the web is dewatered mechanically as far as possible in a press. Then the web is dried in a dry end comprised of heatable drying cylinders. A dry end suitable for this purpose forms the object of German Patent Application P 41 42 524.3, which is equivalent to U S. application No. 07/844,145, filed Mar. 21, 1992 now U.S. Pat. No. 5,241,761 and several U.S. Patents.

One performance requirement for such a paper manufacturing machine is its suitability for extremely high operating speeds, on an order of magnitude of 1000 to 2000 m/min. Despite this high operating speed, the web should travel through the machine with the greatest possible safety, i.e. so that as few web tears as possible result. In other words, the travel efficiency or runability should be as high as possible.

In many cases, there is another requirement, namely drying the paper web to have an extremely low residual moisture content, e.g. of about 2 %. In these cases, drying is substantially more intense than for other types or uses of paper webs in which it is sufficient to obtain a higher residual moisture content in the web, of about 4 to 8 %. The extremely small residual moisture content of about 2% is necessary for producing certain types of paper, such as for the further processing of papers in a coating plant or in a calender. However, the decreased moisture content increases the danger that the paper web will tear, since the paper becomes brittle due to its extreme dryness and/or because the paper shrinks to a great extent, particularly in its longitudinal direction. Such shrinkage produces a quite high longitudinal tension in the web of paper.

When it is herein described that reversing suction rolls lie above or below neighboring dryer cylinders, that means that possibly the entire roll or only part of the roll is above or below the cylinder. However, at least the axes or centers of the rolls are above or below the axes of the dryer cylinders, as described. Some suction rolls can be so small and their axes can be so placed that the entire body of the roller is not beyond the radius of the adjacent dryer cylinders even though the center of the roller is above or below the centers of the adjacent dryer cylinders.

In order to increase the runability in known dryer sections, like that in U.S. Pat. No. 5,241,761, one proposal is now described. In as many dryer groups as possible, at least in the initial, or upstream or wetter region of the dry end, only the lower side of the web comes into contact with the drying cylinders. In other words, in the largest possible number of dryer groups, the drying cylinders all lie above the neighboring reversing suction rolls with which the dryer cylinders alternate along the web path. Only the next to the last dryer group, for instance, has a reverse arrangement in which the drying cylinders lie below the reversing suction rolls so that the top side of the paper web comes into direct contact with the drying cylinders of that group. Accordingly, within the initial region of the dry end, for instance between each two of the first four dryer groups, there are only so called "simple" places of separation between the adjacent dryer groups. This means that the web support belt of the next following succeeding dryer group contacts the last drying cylinder of the preceding dryer group at a place where the web of paper is no longer covered by the web support belt of the preceding dryer group. Such a known development of the place of separation is advantageous in two respects. The threading of the web of paper, for instance upon the starting of the paper machine operation or after a tear of the paper web, takes place completely automatically, without rope guidance being necessary, as is required in older arrangements. The web of paper travels just as reliably during the normal operation of the dry end from each preceding dryer group to the following dryer group. In an exceptional case and despite the favorable manner of construction described above, if a tear should take place in the web of paper, then the reject paper or broke moves readily downward from all drying cylinders of the dryer groups into the basement provided below the dry end.

In order to increase the runability, it is known to keep the web as reliably as possible on the web support belt at the place where the web runs off from each individual drying cylinder, and on the straight travel path from the drying cylinder to the following reversing suction roll. In this respect, the initial region of the dry end presents a particular problem because the paper web is still relatively wet there and it has a tendency to adhere to the wall of the drying cylinder and to detach itself temporarily from the support belt as the web leaves each dryer cylinder. In other words, a so called bubble is formed here between the web of paper and the support belt. In order to reduce the danger of the web of paper tearing, it is attempted to keep said bubble as small as possible. For this purpose, it is known to form a vacuum zone at the run-off place, shown in U.S. Pat. No. 4,359,828, FIG. 3. Another known measure consists of reducing the distance between the drying cylinder and the following reversing suction roll as much as possible, shown in International Application WO 83/00514, FIG. 2, or U.S. Pat. No. 4,905,379, FIG. 1.

SUMMARY OF THE INVENTION

The object of the present invention is to provide a dry end which substantially satisfies both of the requirements mentioned above. Despite an extremely high operating speed, the danger of tearing of the paper web should be reduced as much as possible. At the same time, it should be possible if necessary, to dry the paper web to obtain an extremely low residual moisture content.

These objects are achieved in accordance with the invention. The paper web is provided with a certain initial stress in the direction of web travel upon entrance of the web into the dry end. This is accomplished by having a separation place between the press and the first dryer group, by having independently adjustable drives for the press and the first dryer group, and by adjusting those drives so that there is a positive web speed differential between the press and the first dryer group, where the web speed through the first dryer group is higher. As a result, the bubbles are made small. In addition in the terminal end region of the dry end, a respective separation place between two of the adjacent downstream dryer groups is developed as an open separation by having respective individually adjustable drives for those two dryer groups and by adjusting those drives so that there is a negative web speed differential between the two dryer groups, where the web speed through the later or succeeding dryer group is slower.

These measures reduce the longitudinal stresses in the paper web resulting from the high extent drying which produces a low moisture content in the web.

The above features of the invention are that a positive difference in operating speed can be adjusted between the drive of the press and the drive of the first dryer group while at the same time, a negative difference of speed can be adjusted between at least two adjacent dryer groups in the end region of the dry end.

Another feature of the dry end of the invention is that, at least in the terminal end region of the dry end and at least at that place of separation where the negative difference in web speed is established, an open unsupported paper path or open draw is present. In other words, at least the aforementioned place of separation is developed as an open place of separation or open draw. Preferably, at least in the second half of the dry end, all places of separation between adjacent dryer groups are developed as open places of separation. This not only favors the removal of longitudinal stresses, it takes into account that slight rotary oscillations can occur from time to time in the drive elements. These oscillations cause a danger of producing a sudden, abrupt increase in the longitudinal stress in the web of paper which may cause a tear of the web. However, this danger is avoided with the invention by providing the open separation places, since a sudden increase in the longitudinal stress within a free path, and especially a relatively long free path of travel of the web of paper, is less dangerous than at a closed place of separation.

The invention can be used in connection with various different types of dry ends. However, all of them share the feature that they have exclusively or at least predominantly single tier dryer groups between the press and the place where the final solids content is reached. In a single tier drying group, all of the drying cylinders dry the same side of the web.

A first known drying section design with which the invention can be used has exclusively or at least predominantly web turn over or web reversal separation places. In the dryer group at one side of such a separation place, one side, e.g. the bottom side, of the web is in direct contact with the drying cylinders. In the dryer group at the other side of that separation place, the opposite side of the web, e.g. the top side, is in direct contact with the drying cylinders. Such a construction is shown in U.S. Pat. No. 4,934,067. Its use is preferred when both sides of the web are to come into contact at various intervals and several times with the outer surfaces of drying cylinders. In this known dry end, the turn over separation places or web reversal transfer zones are closed, i.e. at each separation place, the two web support belts travel a certain distance on a common, straight, joint run travel path together with the web sandwiched between them. If the present invention is applied to this known dry end, it is advantageous to modify all of the turn over separation places, or at least the largest number of them, so that they are no longer closed but rather open, i.e. that they have open draws. Various advantages are obtained:

1. At the turn-over separation places of the dry end, the danger of the support belts rubbing against each other and causing wear to each other if there is a difference in speed between them is avoided. This danger is present when the support belts contact each other at the turn over separation places when such a machine is temporarily operating without a paper web. This danger is present continuously and in normal operation at the edges of the support belts since the width of the support belts is greater than the width of the web of paper between the belts.

2. Between the first and the second dryer groups along the web path, a positive difference in speed can be established, exactly in the same way as a speed difference can be established between the press and the first dryer group. This makes it possible to pre-stress the web a second time at this turn over separation place.

3. Also, at the separation places in the dry end at which there is no difference in speed between successive dryer groups, it is advantageous to provide relatively long free web travel so as to prevent the above described danger of tears resulting from occasional oscillations in the rotation of the drive elements.

Another dry end with which the present invention can be used was described above, in German Application P 41 42 524.3 or U.S. application No. 07/844,145. That dry end design has been improved by developing all of the turn over separation places in accordance with the invention as open separation places for the reasons explained above. Whether the so-called "simple" separation spaces should also be developed open depends on the type of paper being dried or on the moisture content still present in the web at the place of separation, and furthermore on the magnitude of the speed difference to be adjusted. In many cases, it is entirely possible to keep a simple separation place closed despite a required difference in speed between two dryer groups. One can imagine that following the place of run off of the preceding web support belt from the last cylinder of the preceding dryer group, up to contact with the succeeding web support belt of the following dryer group, the web detaches itself slightly from the last drying cylinder since a thin layer of vapor forms between the last drying cylinder and the web. Furthermore, the web initially only has loose contact with the support belt of the following dryer group. This contact only becomes more secure at the place where the support belt and the supported web reach the suction zone of the first reversal guide roll of the following dryer group. It is possible that the speed of the support belt of the following dryer group may differ by a small amount from the speed of the last cylinder of the preceding dryer group. This means that the web moves at different speeds in the preceding and following dryer groups. However, because small and sudden changes in speed must be expected from time to time, the resulting danger of a tear can be reduced if the "simple" separation places are also developed as open separation places.

In certain cases, it may be advantageous to operate a so-called "simple" separation place at times open and at times closed. For this purpose, one of the rolls over which the support belt of the following dryer group travels can be movably supported.

In another type of construction of the dry end to which the invention can be applied, the drying cylinders of all of the dryer groups are arranged above the respective reversal suction rolls between adjacent drying cylinders, as defined above, so that only so called "simple" separation places are present. It depends on the individual dry end and the nature of the paper web to be produced whether it is better to operate the separation places open or closed. As a rule, however, it will be advantageous to provide open separation places between the dryer groups at least in the final end region of the dry end where the residual moisture content is already very slight. Stated more precisely, at least the last separation place, or the last two or three separation places, are developed as open separation places. On the other hand, in the upstream region of the dry end, it is usually more advantageous to develop the simple separation places as closed separation places. Again it is advisable, at least in connection with some of the separation places, to provide for the possibility of changing from open separation place to closed separation place, or vice versa.

At a separation place which is developed as an open separation place according to the invention, the web of paper travels across the separation place over a free travel path from the last drying cylinder of the preceding dryer group to the support belt of the following dryer group. The advantages of this measure are identical or similar to those in the case of the dry end constructions described further above. Better handling of paper web shrinkage during progressive drying can be done by driving the following dryer group with a slightly lower speed than the preceding dryer group. If both dryer groups were driven continuously at the same speed, then longitudinal stress wwould be built up in the web of paper due to its shrinkage upon drying. In the extreme case, together with other disturbing factors, this might cause a tear in the web of paper. Driving the two dryer groups in question with a slightly different speed can be attempted even if the place of separation between them is closed. However, at the place where the paper web contacts the last drying cylinder of the preceding dryer group and the support belt of the following dryer group, there is a danger that the surface of the web will be damaged due to the difference in support belt speeds. There is the further factor that in the respective drives for each of the dryer groups of the dry end, as already mentioned, oscillations in drying cylinder rotation sometimes occur. These are more likely to cause a tear of the paper web at a closed separation place than at an open separation place.

Other objects, features and advantages of the present invention will become apparent from the following description of the invention which refers to the accompanying drawings.

DESCRIPTION OF THE PREFERRED EMBODIMENTS

Figure 1:
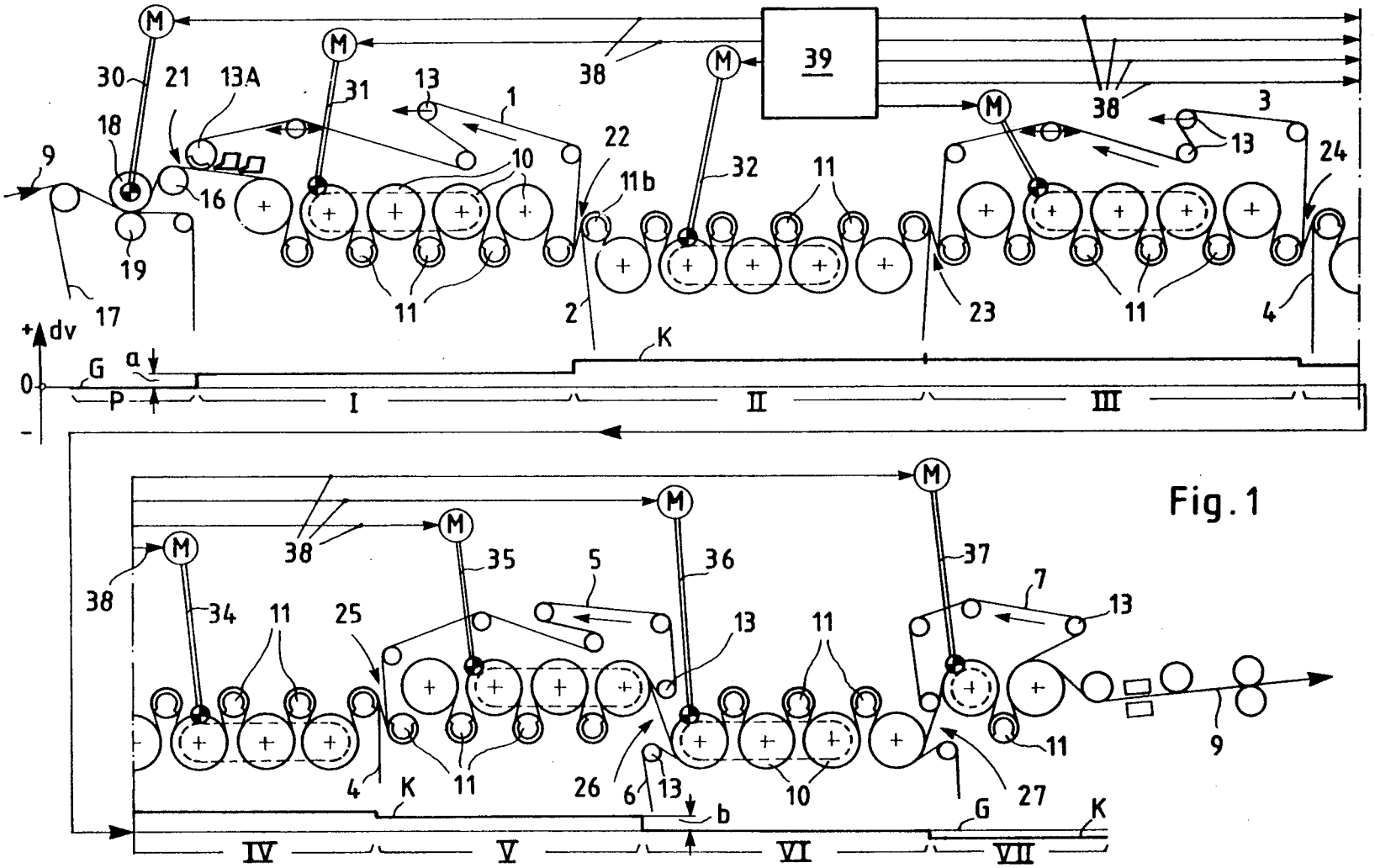
FIG. 1 diagrammatically shows a press and the following dry end of a paper manufacturing machine in which all of the separation places between the dryer groups are developed as turn over or web surface reversal separation places.

FIG. 1 shows a press P which has two press rolls 18 and 19 which together form a paper web dewatering press nip. The web of paper 9 to be dried travels through the press nip together with a dewatering felt 17. The press P is the last press of a press section of a paper making machine. The other parts of such a known press section are not shown. The press46XP has a drive 30 which has been merely diagrammatically shown.

The dry end following the press section comprises seven dryer groups I to VII. Each dryer group has its own respective web support belt 1 to 7, and has a plurality of drying cylinders 10 which alternate with a respective plurality of reversal suction rolls 11. Furthermore, there are guide means comprising customary additional guide rolls 13 for guiding, tensioning and regulating each endless loop support belt. Horizontal rows of drying cylinders are shown. However, vertical or inclined rows of cylinders can also be provided. Each of the dryer groups I to VII has its own respective drive 31–37.

In the dryer groups I, III, V and VII, the drying cylinders 10 are above the adjacent, alternate in the web path, reversal suction rolls 11 so that within these dryer groups, only the bottom side of the paper web 9 comes into direct contact with the drying cylinders. The top side of the web rides on the outside of the support belt 1, 3, 5 or 7 around the rolls 11. In the other, here alternate, dryer groups II, IV and VI, the drying cylinders lie below the reversal suction rolls so that the opposite top side of the web comes into contact with the drying cylinders. In this case, all separation places 22–27 between two adjacent dryer groups are developed as turn over or web side reversal separation places. At all of these turn over separation places, the web of paper travels over a free path of travel or open draw from the web support belt of the preceding dryer group to the web support belt of the following dryer group. In the same way, the web of paper 9 travels from the press roll 18 over a free path of travel to a paper guide roll 16 and, from the guide roll, over another free path of travel to the support belt 1 of the first dryer group I. Here, all separation places 21 to 27 are developed as open separation places.

The respective motor M of each of the drive units 30–37 is connected, via a system of lines 38, with a common speed control device 39. This enables the speed of each individual drive unit to be individually controlled in a known manner. A drive unit rotates the drying cylinders and they, in turn, move the respective endless support belt. The web is moved by the driven support belts and the speed of the drive units determines the speeds of the drying cylinders, of the support belts and therefore of the web. The open separation places 21–27 make it possible for a certain difference in speed dv to be adjusted, at least on some of the separation places between the adjacent drive units. In this connection, it is essential that the difference in speed at the first separation place 21 have a positive value a, that is, the succeeding dryer group operates slightly more rapidly than the preceding dryer group. The speed of the dryer group refers to the speed of the web moving through the dryer group. On the other hand, at least in the outlet end region of the dry end, a negative difference in speed b is established, that is, the succeeding drying group operates slightly slower. The diagram alongside FIG. 1 shows that a positive difference in speed can be provided also between the first two dryer groups I and II at the separation place 22. In other words, the web in the second dryer group II travels slightly faster than the web in the first dryer group I. Two adjacent dryer groups, for instance, groups II and III, can, if necessary, also be driven at the same speed, that is, the web travels at the same speed in both groups. In FIG. 1, the vertical distance between the characteristic line K and the base line G indicates the amount by which the speed of the web in each individual dryer group differs from the speed of the web in the press P. It can be noted from that diagram that the speed of the web in the last dryer group VII is less even than the speed of the web in the press P.

Figure 2:
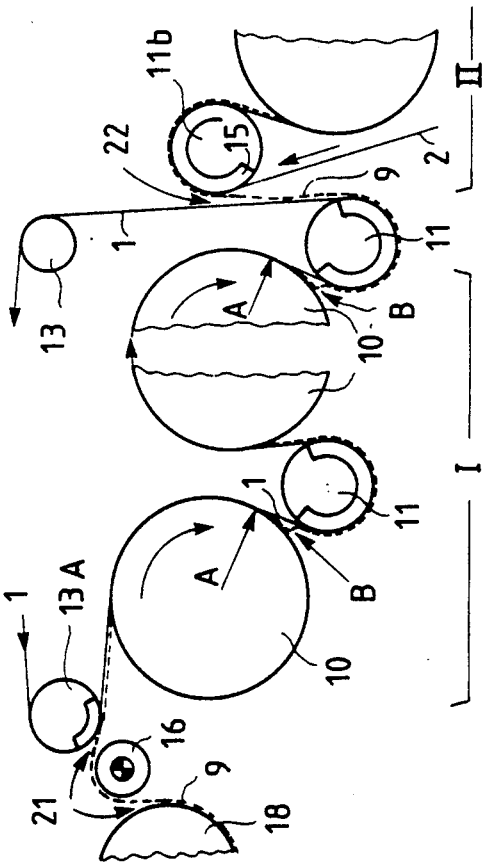
FIG. 2 shows a few details of FIG. 1 on a larger scale.

FIG. 2 shows, on a larger scale than FIG. 1, the first separation place 21 between the press P and the first dryer group I and the second separation place 22 between the first and second dryer groups I and II. It is schematically indicated that the paper guide roll 16 is provided with its own drive, which drive is omitted in FIG. 1, and that the first guide roll 13A of the first dryer group I is developed as a suction roll.

FIG. 2 further shows in an exaggerated manner that the web of paper has a tendency to adhere to the wall of each drying cylinder at the runoff point A from the individual drying cylinder 10 and therefore to temporarily detach itself from the respective support belt 1 of the dryer group. In order that the so called bubble B produced at the run off place remain as small as possible, the drive 31 for the first dryer group I is adjusted to a somewhat higher speed than the drive 30 for the press P. Consequently, the web arrives at the runoff point A with a certain longitudinal pre-tension. For the same reason, the drive for the second dryer group II is driven with a somewhat greater speed than the drive for the first dryer group I. In order to make this possible, the first reversal suction roll 11*b* of the second dryer group II is arranged at a distance from the support belt 1 of the first dryer group I, as shown in FIG. 2. Accordingly, the paper web 9 travels in a free travel path or open draw from the support belt 1 to the support belt 2.

Figure 6:
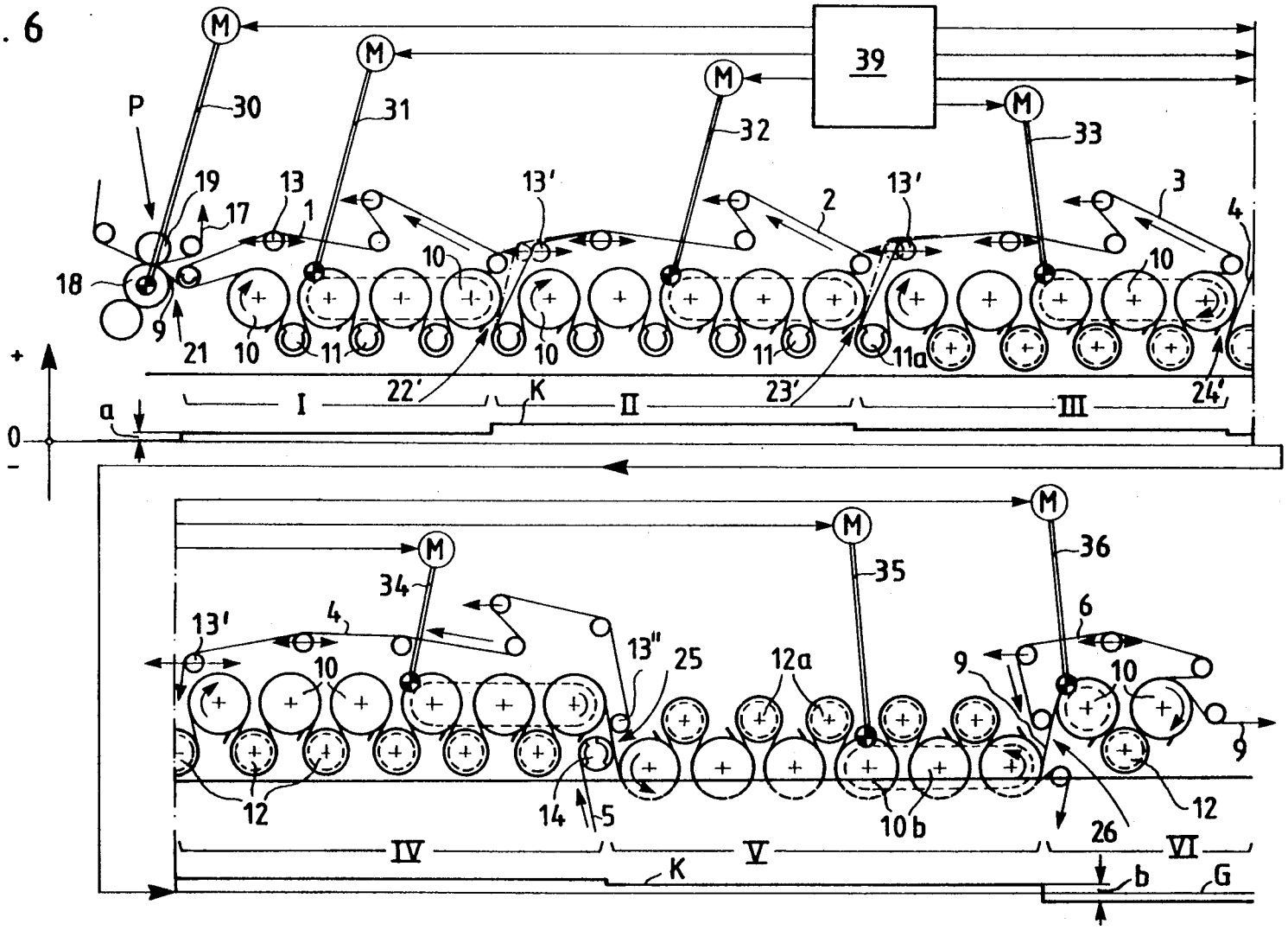
FIG. 6 shows a press and the dry end of a paper manufacturing machine in which only the last two separation places are developed as turn over, web reversal separation places.

As a whole, the travel path of the web of paper from the last drying cylinder of the first dryer group to the first drying cylinder of the second dryer group has a meander like course. This enables a relatively large zone of contact with the paper web on each of the drying cylinders. However, it is also possible to provide a substantially linear travel path, tangential to the drying cylinder, for the web of paper. In this case, the support belts do not travel over suction rolls at the place of separation but over normal guide rolls 13. As shown in FIG. 6, at separation place 25, a normal guide roll 13", on which the web separates from the support belt 4, can also be combined with a suction roll 14 at which the web travels onto the following support belt 5.

Figure 3:
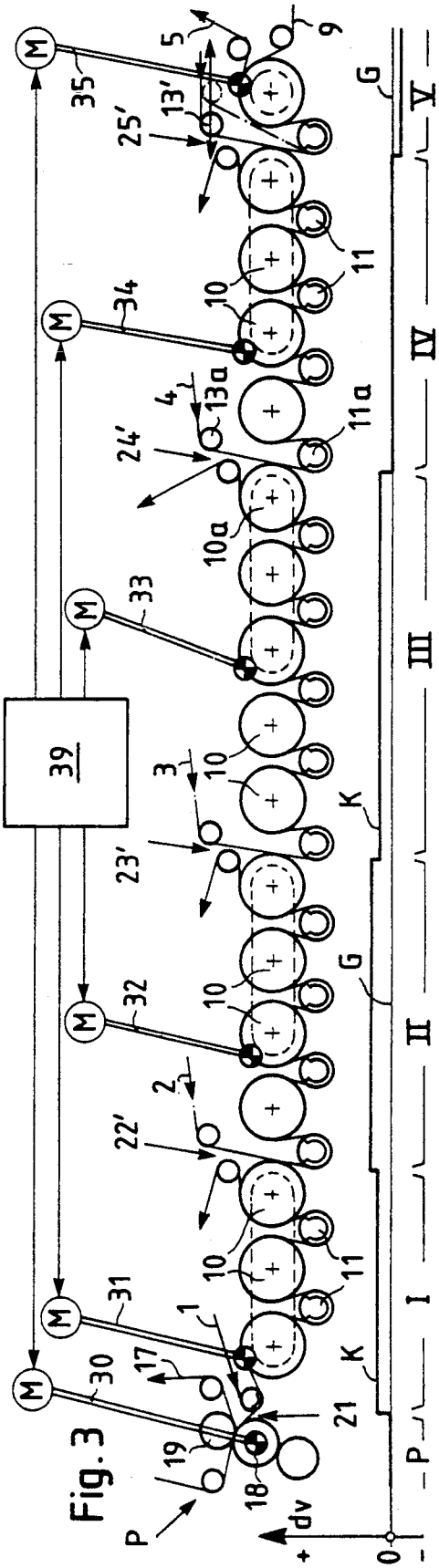
FIG. 3 shows a press and the dry end of a paper manufacturing machine in which all separation places between the dryer groups are developed as simple separation places.

In the embodiment shown in FIG. 3, the drying cylinders 10 are arranged above the reversal suction rolls 11 in all of the dryer groups I–V. Accordingly, only the bottom side of the web 9 comes into contact with the drying cylinders within that entire dry end. The separation places 22'–25' present within the dry end are therefore developed as so called "simple" separation places. This means, for instance, that at the separation place 22', the support belt 2 of the following dryer group II contacts the last drying cylinder of the first dryer group I. That support belt wraps around that cylinder to a greater or less extent. This contact takes place at the point where the web of paper is no longer covered by the first support belt 1. This, therefore, is a "closed simple" separation place. For the above indicated reasons, an "open simple" separation place can also instead be provided as shown at 24' in FIG. 3. Here, a guide roll 13*a* and the first reversal suction roll 11*a* for the support belt 4 of the fourth dryer group IV are so arranged behind the last drying cylinder 10*a* of the third dryer group III that the support belt 4 passes at a slight distance away from the drying cylinder 10*a*. Finally, it is possible to operate a simple separation place optionally either open or closed by displacing a guide roll 13'. The roll 13' is supported to be moveable. This is diagrammatically shown at 25' in FIG. 3.

Figure 5:
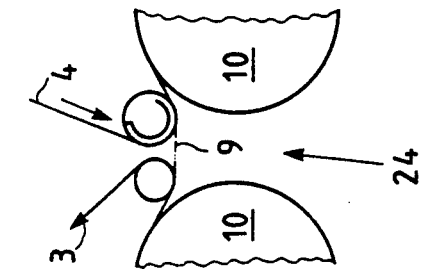
FIGS. 4 and 5 show first and second modified separation places for the paper manufacturing machine shown in FIG. 3.
Figure 4:
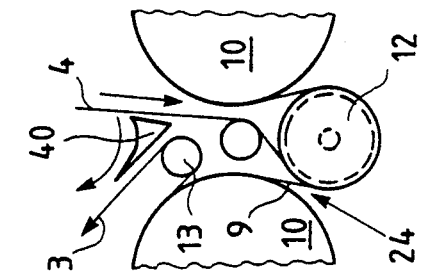

Other possible embodiments for open separation places are shown in FIGS. 4 and 5. In each case, the contact zones of the paper web 9 are of different size on the drying cylinders. FIG. 4 also shows a removal or reversal element 40 for the air boundary layer arriving with the support belt.

In FIG. 6, six dryer groups I–VI are shown. Between the dryer groups I–IV, there are simple separation places 22'–24' which can be operated either open or closed, as desired, by displacing a movable guide roll 13'. Only the next to the last dryer group V has bottom drying cylinders 10*b* and upper reversal suction rolls 12*a*. Thus, the separation places 25 and 26 between the dryer groups IV, V and VI are developed as turn over separation places. The dry end shown in FIG. 6 has different reversal suction rolls 11 and 12, 12*a*. In the first two dryer groups I and II, reversal suction rolls 11 of relatively small diameter and having stationary suction boxes within them are provided. One such reversal roll 11*a* is also arranged at the beginning of the third dryer group III. Behind it there are provided in the dryer groups III–VI on the other hand box-less suction rolls 12 or 12*a* of larger diameter, in connection with which the air is drawn off directly through the rotating hollow journals. See U.S. application No. 07/844,145, filed Mar. 21, 1992.

In both FIGS. 3 and 6, the control of the drives, for instance 30–36, takes place in the same manner as in FIG. 1. In the diagrams included with the Figures, the characteristic line K again shows that a positive difference in speed a is adjusted at least between the press P and the first dryer group I, and preferably also between the first two dryer groups I and II, while a negative difference in speed is adjusted between the terminal end dryer groups.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A machine for manufacturing a paper web, the machine including a dewatering press through which the web is moved and a dry end following the dewatering press in the path of the web;

the dry end comprising a plurality of dryer groups arranged one after the other along the path of the web through the dry end; each dryer group comprising: a single row of heatable drying cylinders; a reversal suction roll between each two drying cylinders in the group; an endless, web support belt which supports the web to travel together with the support belt through the dryer group; guide means in each dryer group for guiding the respective support belt in an endless loop through the respective dryer group;

the support belt passes through the dryer group in a meander path so that the web on the support belt directly contacts one of the drying cylinders in the respective dryer group, the support belt then touches the next reversal roll in sequence and the web then touches the next drying cylinder in sequence so that the web comes into direct contact with the drying cylinders and the support belt comes into direct contact with the reversal suction rolls;

the press is so placed and the drying cylinders, the suction reversal rolls and the support belt of the first dryer group after the press are so placed that there is a first, open separation place where the web travels free of support between the press and the first dryer group;

the respective drying cylinders, suction reversal rolls and guide means of each of the dryer groups being so placed so as to define a respective separation place between each preceding dryer group and the succeeding dryer group thereafter in the path of the web through the dry end, and including means at the separation place for transferring the web from the preceding dryer group to the succeeding dryer group in the dry end;

at least toward the terminal end region of the path of the web through the dry end, at least one of the separation places between a preceding and a succeeding dryer group is developed as an open separation place where the web has a free unsupported path of travel from the respective preceding to the respective succeeding endless web support belt of the dryer groups;

a respective drive means for the press for driving the press to move a web through the press to the first dryer group of the dry end;

respective drive means for driving the drying cylinders in each of the dryer groups to rotate to move the web through the dryer group; each of the drive means for each of the dryer groups has a drive which is adapted to produce a selectively variable rotation speed for the drying cylinders in that dryer group, and a respective speed control device for the drying cylinders of each of the dryer groups for enabling adjustment to produce a difference in rotation speeds between the drying cylinders of adjacent dryer groups;

at least the drive of the press and of the first dryer group following the press being set to achieve a positive speed difference at the first separation place, the positive speed difference meaning that the speed of the web through the first dryer group is greater than the speed of the web through the press, thereby relieving the tendency of the web to adhere to the surfaces of the drying cylinders of at least a first one of said plurality of dryer groups;

in the dry end, at the separation place between two of the dryer groups that are toward the terminal end of the path of the web away from the press, the drives of the two dryer groups being set to a negative speed difference where the support belt in the succeeding dryer group is moving the web slower than the support belt in the preceding group is moving the web, thereby enabling attaining a paper web with extremely low moisture content.

2. The machine of claim 1, wherein in the dry end, at least some of the separation places between a preceding and a succeeding dryer group are turn over separation places, wherein the web is supported on the support belt and against the drying cylinders in the preceding dryer group so that one side of the web contacts the drying cylinders in the preceding dryer group, and the web is supported on the support belt in the succeeding dryer group so that the opposite side of the web is in direct contact with the drying cylinders in the succeeding dryer group.

3. The machine of claim 2, wherein there are at least three of the dryer groups, the respective support belts of the three dryer groups support the web so that in the first of the three dryer groups, the one side of the web is in direct contact with the respective dryer cylinders, in the second of the three dryer groups, the opposite side of the web is in contact with the respective drying cylinders, and in the third of the three dryer groups, the one side of the web is again in contact with the respective drying cylinders.

4. The machine of claim 3, wherein in one of the first and second dryer groups, the suction reversal rolls are above the drying cylinders, and in the other of the first and second dryer groups, the suction reversal rolls are below the drying cylinders.

5. The machine of claim 2, wherein in at least the first dryer group following the press, all of the drying cylinders lie above the reversal suction rolls so that all of the drying cylinders come into contact with the bottom side of the web.

6. The machine of claim 5, wherein there are a plurality of the dryer groups in series following the press along the path of web travel, in each of a first plurality of the dryer groups following the press, the reversal suction rolls lies above the neighboring drying cylinders so that all of the drying cylinders in the first plurality of drying groups come into contact with the bottom side of the web and so that simple separation places are defined between neighboring ones of the first plurality of dryer groups.

7. The machine of claim 6, wherein the drying cylinders, the reversal suction rolls and the guide means of two neighboring dryer groups of the first plurality of dryer groups are so placed and shaped as to define the respective simple separation place between those two dryer groups as an open separation place, wherein the support belt of the succeeding one of the two first plurality dryer groups is out of contact with the final drying cylinder in the web path of the preceding one of the two first plurality dryer group.

8. The machine of claim 7, wherein at least at the part of the dry end toward the terminal end thereof along the path of web travel, all of the drying cylinders, the suction reversal rolls and the guide means of neighboring dryer groups are so placed that all of the separation places between those neighboring dryer groups are developed as open separation places.

9. The machine of claim 7, wherein the drying cylinders, the reversal suction rolls and the guide means of all of the first plurality of dryer groups are so placed that all of the separation places between those neighboring dryer groups are open separation places.

10. The machine of claim 1, wherein the drying cylinders, the reversal suction rolls and the guide means in all of at least a plurality of the dryer groups are so placed that the drying cylinders are above the reversal suction rolls such that only the bottom side of the web contacts the drying cylinders.

11. The machine of claim 6, wherein the drying cylinders, the reversal suction rolls and the guide means of the next to last dryer group in the path of the web through the dry end are so placed that the drying cylinders of the next to last dryer group lie below the respective reversal suction rolls of the next to the last dryer group such that only the top side of the web contacts the drying cylinders in that group, while the dryer cylinders, the reversal suction rolls and the guide means of all of the other dryer groups are so placed that the drying cylinders of all of the other dryer groups are arranged above the reversal suction rolls of all of the other dryer groups.

12. The machine of claim 11, wherein there is a respective separation place both preceding and following the next to last dryer group; the respective drying cylinders, reversal suction rolls and guide means of the next to last dryer group, of the last dryer group and of the dryer group preceding the next to last dryer group along the path of the web through the dry end are so placed and shaped as to cause the separation places between the dryer group preceding the next to last dryer group and the last dryer group succeeding the next to last dryer group to be open separation places wherein the web is not supported by the support belt as it moves to and then away from the next to last dryer group.

13. The machine of claim 12, wherein the respective drying cylinders, reversal suction rolls and guide means of the fourth from the last and the third from the last dryer groups in the path of the web through the dry end are so placed that at least the separation place between the fourth from the last and the third from the last dryer groups is developed as an open separation place at which the respective support belts of the third and fourth dryer groups from the last do not support the web and the web passes unsupported from the fourth from the last to the third from the last dryer group.

14. The machine of claim 6, wherein the respective drying cylinders, reversal suction rolls and guide means of the fourth from the last and the third from the last dryer groups in the path of the web through the dry end are so placed that at least the separation place between the fourth from the last and the third from the last dryer groups is developed as an open separation place at which the respective support belts of the third and fourth dryer groups from the last do not support the web and the web passes unsupported from the fourth from the last to the third from the last dryer group.

15. The machine of claim 6, wherein for at least one of the dryer groups following at least one of the simple separation places between neighboring ones of the dryer groups, the guide means for the support belt comprises a guide roll for the support belt of the dryer group that follows the preceding dryer group, and that guide roll of a following dryer group is supported for being moveable in a manner in which the separation place can be operated optionally opened for providing a space where the web runs unsupported from the preceding dryer group to the following dryer group or closed where the support belts of the two dryer groups are in contact and the web is supported in its movement across the separation place.

16. A dry end for a machine for manufacturing a paper web comprising:

a plurality of dryer groups arranged one after the other along the path of the web through the dry end; each dryer group comprising: a single row of heatable drying cylinders; a reversal suction roll between each two drying cylinders in the group; an endless, web support belt which supports the web to travel together with the support belt through the dryer group; guide means in each dryer group for guiding the respective support belt in an endless loop through the respective dryer group;

the support belt passes through the dryer group in a meander path so that the web on the support belt directly contacts one of the drying cylinders in the respective dryer group, the support belt then touches the next reversal roll in sequence and the web then touches the next drying cylinder in sequence so that the web comes into direct contact with the drying cylinders and the support belt comes into direct contact with the reversal suction rolls;

the respective drying cylinders, suction reversal rolls and guide means of each of the dryer groups being so placed so as to define a respective separation place between each preceding dryer group and the succeeding dryer group thereafter in the path of the web through the dry end, and including means at the separation place for transferring the web from the preceding dryer group to the succeeding dryer group in the dry end;

the drying cylinders and the reversal suction rolls in all of the plurality of the dryer groups are so placed that the drying cylinders are above the reversal suction rolls such that only the bottom side of the web contacts the drying cylinders.

17. A method for manufacturing a paper web with a machine including a dewatering press through which the web moves and a dry end following the dewatering press in the path of the web, the method including the steps of:

providing in the dry end a plurality of dryer groups arranged one after the other along the path of the web through the dry end; a single row of heatable drying cylinders; a reversal suction roll between each two drying cylinders in the group; an endless, web support belt which supports the web to travel together with the support belt through the dryer group; guide means in each dryer ground for guiding the respective support belt in an endless loop through the respective dryer group; the support belt passing through the dryer group in a meander path so that the web on the support belt directly contacts one of the drying cylinders in the respective dryer group, the support belt then touches the next reversal roll in sequence and the web then touches the next drying cylinder in sequence so that the web comes into direct contact with the drying cylinders and the support belt comes into direct contact with the reversal suction rolls; the press being so placed and the drying cylinders, the suction reversal rolls and the support belt of the first dryer group after the press being so placed that there is a first, open separation place where the web travels free of support between the press and the first dryer group; the respective drying cylinders, suction reversal rolls and guide means of each of the dryer groups being so placed so as to define a respective separation place between each preceding dryer group and the succeeding dryer group thereafter in the path of the web through the dry end, and including means at the separation place for transferring the web from the preceding dryer group to the succeeding dryer group in the dry end; at least toward the terminal end region of the path of the web through the dry end, at least one of the separation places between a preceding and a succeeding drying group being developed as an open separation place where the web has a free unsupported path of travel from the respective preceding to the respective succeeding endless web support belt of the dryer groups;

driving the press to move a web through the press to the first dryer group of the dry end;

driving the drying cylinders in each of the dryer groups to rotate to move the web through the dryer group at a selectively variable and respective rotation speed and controlling the respective rotation speed of the drying cylinders of each of the dryer groups for enabling adjustment to produce a difference in rotation speeds between the drying cylinders of adjacent dryer groups; and setting the respective drive speed of the press and of the first dryer group following the press to achieve a positive speed difference at the first separation place, the positive speed difference meaning that the speed of the web through the first dryer group is greater than the speed of the web through the press, thereby relieving the tendency of the web to adhere to the surfaces of the drying cylinders of at least a first one of said plurality of dryer groups;

setting the respective drive speed, in the dry end, at two of the dryer groups that are toward the terminal end of the path of the web away from the press, to a negative speed difference so that the support belt in the succeeding dryer group is moving the web slower than the support belt in the preceding dryer group is moving the web, thereby enabling attaining a paper web with extremely low moisture contact.

18. The method of claim 17, including supporting the web on the support belt and against the drying cylinders in the preceding dryer group so that one side of the web contacts the drying cylinders in the preceding dryer group, and supporting the web on the support belt in the succeeding dryer group so that the opposite side of the web is in direct contact with the drying cylinders in the succeeding dryer group.

19. The method of claim 17, including, at terminal end along the path of web travel, placing all of the drying cylinders, the suction reversal rolls and the guide means of neighboring dryer groups so that all of the separation places between those neighboring dryer groups are developed as open separation places.

20. The method of claim 17, including configuring and controlling a given separation place between adjacent dryer groups such that a space where the web runs unsupported from the preceding dryer group to the following dryer group can be selectively maintained opened or closed at the location where the support belts of the two dryer groups are juxtaposed across the separation place.

* * * * *